US008661580B2

(12) United States Patent
Giap

(10) Patent No.: US 8,661,580 B2
(45) **Date of Patent: *Mar. 4, 2014**

(54) PATIENT POSITIONING DEVICE

(75) Inventor: Brandon Cuongquoc Giap, San Diego, CA (US)

(73) Assignee: BCG Medical, LLC, San Diego, CA (US)

( * ) Notice: Subject to any disclaimer, the term of this patent is extended or adjusted under 35 U.S.C. 154(b) by 94 days.

This patent is subject to a terminal disclaimer.

(21) Appl. No.: 13/153,432

(22) Filed: Jun. 5, 2011

(65) Prior Publication Data

US 2011/0296609 A1 Dec. 8, 2011

Related U.S. Application Data

(60) Provisional application No. 61/351,769, filed on Jun. 4, 2010.

(51) Int. Cl.
*A61G 7/10* (2006.01)

(52) U.S. Cl.
USPC ..... 5/88.1; 5/628; 128/870

(58) Field of Classification Search
USPC ..... 5/625–629, 81.1 HS, 81.1 T, 926, 88.1, 5/621; 128/870, 869
See application file for complete search history.

(56) References Cited

U.S. PATENT DOCUMENTS

| | | | | |
|---|---|---|---|---|
| 3,295,518 A | | 1/1967 | Hazlewood et al. | |
| 3,613,676 A | | 10/1971 | Endres et al. | |
| 3,861,666 A | * | 1/1975 | Nishiyama et al. | 5/601 |
| 3,862,632 A | | 1/1975 | Hinsch | |
| 4,349,019 A | | 9/1982 | Singer | |
| 4,614,000 A | | 9/1986 | Mayer | |
| 4,858,625 A | * | 8/1989 | Cramer | 128/872 |
| 5,012,821 A | * | 5/1991 | Tarver | 128/876 |
| 5,014,724 A | * | 5/1991 | Miller | 128/870 |
| 5,076,288 A | * | 12/1991 | Millard et al. | 128/869 |
| 5,165,122 A | | 11/1992 | Phalen | |
| 5,211,186 A | * | 5/1993 | Shoemaker et al. | 5/628 |
| 5,413,118 A | | 5/1995 | Thompson | |
| 5,546,963 A | | 8/1996 | Doody | |
| 5,651,375 A | * | 7/1997 | Cunningham | 128/869 |
| 5,742,958 A | | 4/1998 | Solazzo | |

(Continued)

OTHER PUBLICATIONS

"LapWrap Positioning Pad Set Up Instructions", Oct. 2010, p. 1-2, Innovative Medical Products, Inc., Plainville, Connecticut.

*Primary Examiner* — Michael Trettel
*Assistant Examiner* — Myles Throop
(74) *Attorney, Agent, or Firm* — Malin, Haley, DiMaggio & Bowen, P.A.

(57) ABSTRACT

A patient positioning device provided to position, protect and secure a patient on a support surface for transfer to another support surface or for preparation for surgery. The positioning device includes a sheet with a first and second flexible substrate coupled to the sheet's top surface. The first and second flexible substrates may be padded. These substrates are capable of wrapping around an adjacent arm of the patient creating a wrapped engagement. This wrapped engagement may pad, protect, secure and elevate the arms from injury caused by pressure imparted thereon during surgery or transport. This positioning device may be lifted or slid from one support surface to another. Optionally, a third and fourth flexible substrate capable of wrapping around an adjacent arm of the patient creating a second wrapped engagement may be used for additional securing. Optionally, an inflatable support may be used with the device to aid when sliding or translating the device 10 with the patient thereon.

19 Claims, 7 Drawing Sheets

(56) References Cited

U.S. PATENT DOCUMENTS

| | | | | |
|---|---|---|---|---|
| 5,860,174 | A * | 1/1999 | Failor | 5/81.1 HS |
| 5,881,410 | A | 3/1999 | Yamada | |
| 6,585,672 | B1 * | 7/2003 | Crompton | 602/32 |
| 7,032,261 | B2 * | 4/2006 | Heimbrock | 5/81.1 HS |
| 7,243,382 | B2 | 7/2007 | Weedling et al. | |
| 7,464,421 | B2 | 12/2008 | Goodwin et al. | |
| 7,818,836 | B2 * | 10/2010 | Stinson | 5/487 |
| 7,962,984 | B2 * | 6/2011 | Popp | 5/640 |
| 7,975,330 | B2 * | 7/2011 | Receveur et al. | 5/81.1 HS |
| 8,001,635 | B2 | 8/2011 | Humbles | |
| 8,214,951 | B1 * | 7/2012 | Batta | 5/647 |
| 2005/0091749 | A1 * | 5/2005 | Humbles | 5/646 |
| 2006/0253976 | A1 * | 11/2006 | Weedling et al. | 5/81.1 R |
| 2009/0271923 | A1 | 11/2009 | Lewis | |
| 2010/0089411 | A1 * | 4/2010 | Porter, III | 128/889 |
| 2010/0199435 | A1 * | 8/2010 | Jensen et al. | 5/628 |
| 2011/0098794 | A1 | 4/2011 | Anderson et al. | |
| 2012/0079656 | A1 | 4/2012 | Lewis | |
| 2013/0104907 | A1 * | 5/2013 | Giap | 128/845 |
| 2013/0152950 | A1 * | 6/2013 | Giap | 128/872 |

* cited by examiner

PATIENT POSITIONING DEVICE

CROSS REFERENCE TO RELATED APPLICATIONS

This application claims priority benefit to U.S. Provisional Application No. 61/351,769, entitled "Patient Transfer System With Arm Protector" filed Jun. 4, 2010 and, which is incorporated by reference in its entirety herein as if it was put forth in full below.

BACKGROUND OF THE INVENTION

The transfer of a patient from one support platform to another is a difficult procedure for hospital staff. In a hospital setting, patients are constantly being moved. For example, a patient entering the hospital via ambulance is moved from the medical stretcher or ambulance gurney to a hospital gurney, a fixed hospital bed, an examination table, or an operating table. Also, patients already in a hospital need to be moved as well. For example, a patient having surgery may be moved from a fixed hospital bed to a hospital gurney then to an operating table and finally back to a fixed hospital bed. Each time a patient is moved a sliding or lateral movement of the patient from one support surface to another is required.

Difficulties for patients and hospital staff may arise from this lateral transferring of patients. Typically, the hospital staff acting in concert is responsible to position and move the patient to the new support surface by means of lifting, sliding or dragging. This action may cause injury to the patient if the patient accidently slides off of the support surface or if the patient is dropped. Also the hospital staff may be injured from the act of lifting, sliding or dragging a heavy patient.

For most surgical procedures, the patient is placed on the operating table with the patient's arms positioned at the patient's sides. The surgeon will typically stand adjacent to the patient's side and lean over the patient thus unintentionally leaning on the patient's arm. Many surgeries last several hours and the pressure of the surgeon's body on the patient's arm may cause damage to the patient's arm, wrist or hand.

Furthermore, leaning on the arm or hand of a patient for a long surgery may cause a restriction in blood flow as well as pressure on muscles and nerve tissue. Consequently, patients may awake from the procedure with sustained permanent damage to the muscles and/or nerves of the arm, hand, or wrist. Even if the surgeon doesn't lean on the patient's arm, the patient is at risk for ulnar nerve damage which may be caused from resting the arms on a surface for extended periods of time.

The prior art teaches various systems designed to move patients without actually lifting. These systems employ air rollers, pull straps and inflation as a means to drag patients to and from support surfaces. Many of these systems are intended for single-patient/single-use application, such that the devices stays with the patient from the hospital bed to the operating room table.

It is known in the art that patients in a hospital setting may be agitated, intoxicated or confused (such as when emerging from anesthesia), and may cause unintentional self-harm such as rubbing eyes or pulling out the intravenous lines. The prior art teaches arm protector devices used during surgeries but these designs are constructed of rigid materials and are not secured to the support surface.

Finally, the prior art teaches a patient mounted intravenous protector. This device employs a means to secure intravenous needles in a patient's arm from accidental or patient initiated removal. Although this device provides structural support about a patient's arm, its application is not desirable for surgical operations due to its bulk.

BRIEF SUMMARY OF THE INVENTION

Described herein is a patient positioning device used to position, protect and secure a patient on a support surface for transfer to another support surface or for preparation for surgery. The positioning device includes a sheet with a first and second flexible substrate coupled to the sheet's top surface. The first and second flexible substrates may be padded. These substrates are capable of wrapping around an adjacent arm of the patient creating a wrapped engagement. This wrapped engagement may pad, protect, secure and elevate the arms from injury caused by pressure imparted thereon during surgery or transport. This positioning device may be lifted or slid from one support surface to another. Optionally, a third and fourth flexible substrate capable of wrapping around an adjacent arm of the patient creating a second wrapped engagement may be used for additional securing. Optionally, an inflatable support may be used with the device to aid when sliding or translating the device 10 with the patient thereon.

The present invention is better understood upon consideration of the detailed description below in conjunction with the accompanying drawings and claims.

DETAILED DESCRIPTION

Figure 1:
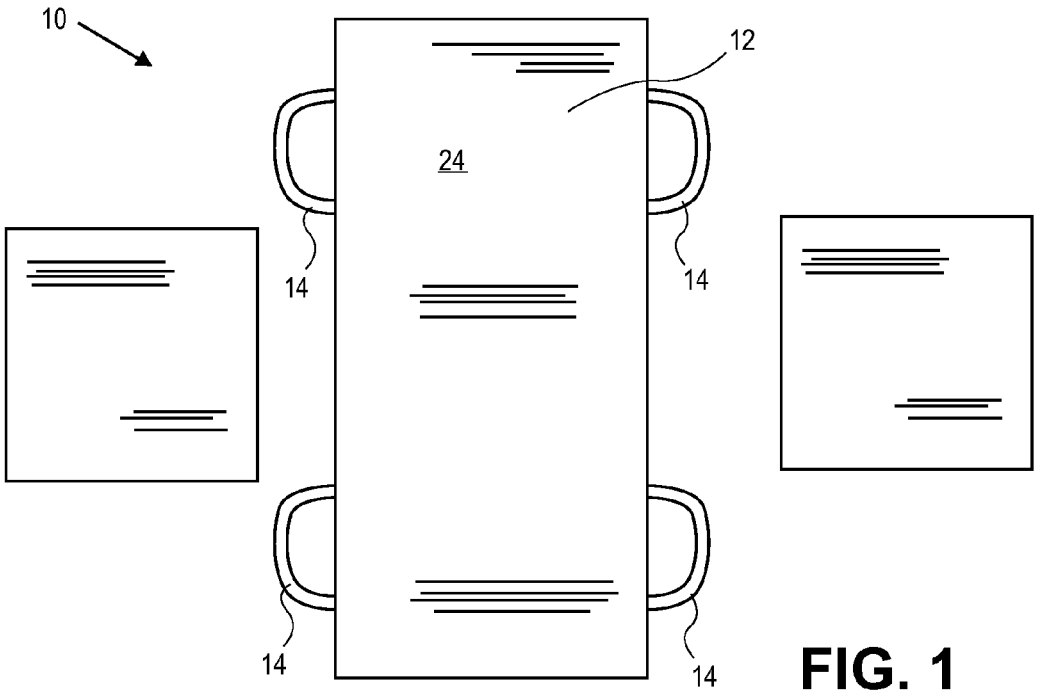
FIG. 1 depicts a patient positioning device.

The following description is presented to enable a person of ordinary skill in the art to make and use the invention.

Descriptions of specific materials, techniques, and applications are provided only as examples. Various modifications to the examples described herein will be readily apparent to those of ordinary skill in the art, and the general principles defined herein may be applied to other examples and applications without departing from the spirit and scope of the invention. Thus, the present invention is not intended to be limited to the examples described and shown, but is to be accorded the scope consistent with the appended claims.

A patient positioning device is described that can be used for moving and lifting a patient from one surface to another surface in a hospital setting. Examples of such a device are described that are adapted for easy lifting of a patient, to and from an operating table, which offers ease of use for lifting the patient and protection of the patient's arms and legs during surgery and transport.

Items and/or techniques described herein may provide one or more of the following capabilities. Injuries to both patient and hospital staff during transition between one support surface and another can be reduced or avoided. Secure transition of a patient during transfer between support surfaces can be provided. A secure means is provided to grip a patient transfer device. Further, in order to help prevent injuries to the hospital staff during such transitions of a patient, a patient positioning device provides means to evenly apportion an amount of weight a person lifting a patient will bear. A patient positioning device also protects the patient from injury during a surgical procedure by protecting the patient's arms from lying too long upon an operating table, and protecting the patient's arms from damage should a surgeon or other hospital staff member lean upon the patient's arm during the surgery.

Examples of a patient positioning device provide secure lifting means to help prevent dropping of the patient during a transfer or transition, and means to easily slide the patient to and from surfaces to thereby limit the amount of weight any one person supports during lateral transfer of the patient. Patient positioning devices are provided that are relatively inexpensive to help insure widespread use so as to help prevent injuries to all concerned.

Means are provided to protect a patient's arm from pressure damage while in surgery, as well as provide the choice of protection for either one or both arms. Means are provided to protect a patient's arm while in surgery with the means adapted to be employed with existing medical equipment, such as patient transfer systems. Means are provided to attach a patient transfer device using multiple straps, in the form of hook-and-loop fasteners or a buckle, along both sides of a central section to secure the sheet on a support surface. Means are provided to restrain a patient's arm to the patient's body along with protecting the patient's arm while in surgery. Back and other injuries to the hospital staff from lifting a patient may be prevented by providing multiple handles for lifting and sliding a patient.

Figure 2:
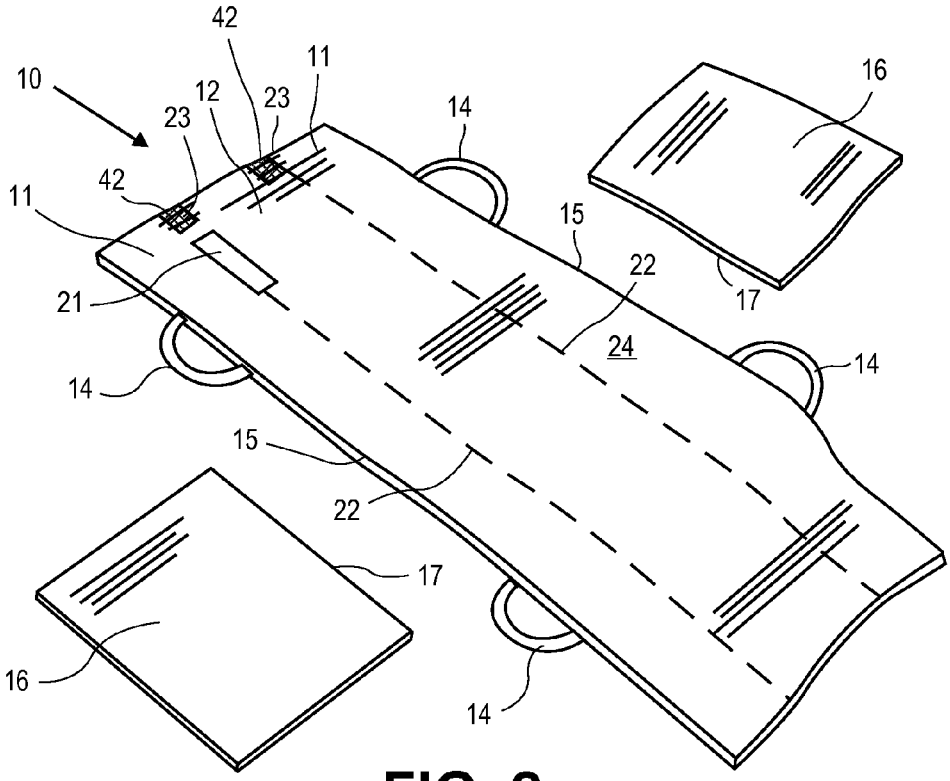
FIG. 2 shows a perspective view of a mode of the device.

FIGS. 1 and 2 show the patient positioning device 10. A top surface 24 is positioned opposite the bottom surface 26. The top surface 24 and bottom surface 26 are formed of flexible fabric sheet and composed of center section 12, overhang sections 11, outer edge of center section 22 and outer edge of overhang sections 15. The center section 12 is of a rectangular geometry and adapted in length and width to accommodate the size and shape of a human being. Further, the center section 12 is sized to be laid on an operating room table which varies between, for example, 20-24 inches, or a stretcher or gurney with a width between, for example, 22-27 inches. Overhang sections 11 extend from the sides of center section 12. These overhang sections may be tucked under the mattress or pad on a gurney or table providing a means for the device 10 to operate in place of a bed sheet thus reducing germs and cost. Outer edge of center section 22 is a point of attachment for various components described hereafter.

Handles 14 are attached to outer edge of overhang sections 15 which allow for a safe grip on the device when used for lifting and pulling the device after the patient is secured. The quantity and orientation of handles 14 is not limited by the drawing as shown but is merely simplified for illustrative purposes.

The top and bottom surface, 24 and 26 respectively, may be of different material each of which is adapted for a specific purpose. The top surface 24 may be made of textile or paper reinforced with textile fabric, or another woven or knitted fabric adapted to the task of supporting a patient thereon. The bottom surface 26 of the device may have a surface configured to have low friction when the device 10, with patient aboard, is slid during a transition. The bottom surface 26 is composed of material which is slippery or has a low coefficient of friction, so as to allow the medical staff a means to easily slide the patient to and from a support surface. One example for a top surface 24 is a paper cloth or similar woven or knitted textile surface. The bottom surface which is exposed, may be formed of any low friction material as would occur to those skilled in the art including but not limited to one or a combination of materials from a group including PTFE impregnated or coated fabric, spunbond or other fabric when woven or formed has a slippery surface, or fabrics such as rip-stop or micro fiber-based materials woven or knitted from woven nylon, or polyester. The slippery bottom surface 26 may be sewn or laminated or coated to the device 10 or on the opposite side of the material forming the top surface 24 of the center section 12.

Referring to FIG. 2, equipment straps 23 and pocket 21 are detailed. Equipment Straps 23 are fastened to top surface 24 at one end and contain hook and loop fasteners. Directly under equipment straps 23, and coupled to top surface 24, is a group 42 of hook and loop fasteners. The equipment straps 23 are fastened to group 42. Pocket 21 is coupled to top surface 24 having one open end. Both equipment straps 23 and pocket 21 may be used to secure a medical device, an intravenous tube, a catheter tube and/or a piece of medical equipment that is attached directly to the patient.

FIGS. 1 and 2 also show two disengaged padded substrates 16 which are substantially planar. These padded substrates 16 are flexible and have an inner edge 17 that may be permanently fastened to center section 12 by sewing with durable thread or another suitable means, or temporarily fastened with a hook and loop fastener, such as Velcro® or other such removable fasteners. In one embodiment, padded substrates 16 are temporarily removed from device 10 so they may be employed on pre-existing patient transfer devices as described in the prior art which lack protection for the patient's arms.

Padded substrates 16 are positioned with respect to the top edge of the central area of the center section 12 at a distance comparable to the distance of a human arm, between the upper arm and hand, when placed to the side, to the human head. Preferably, padded substrates 16 have a layer of padding imbedded or engaged such that when engaged around the arm of a patient, a means to pad the arm is provided. This protects the patient's arm from any pressure forces imparted by the table or by a surgeon. Padded substrates 16 also are configured to engage around the arms of the patient, and hold them against their body and slightly elevated from the underlying table or support surface. This helps eliminate injury to the patient's arm when it is supported on a hard table surface for a long duration by placing a gap between the table and arm.

Figure 3:
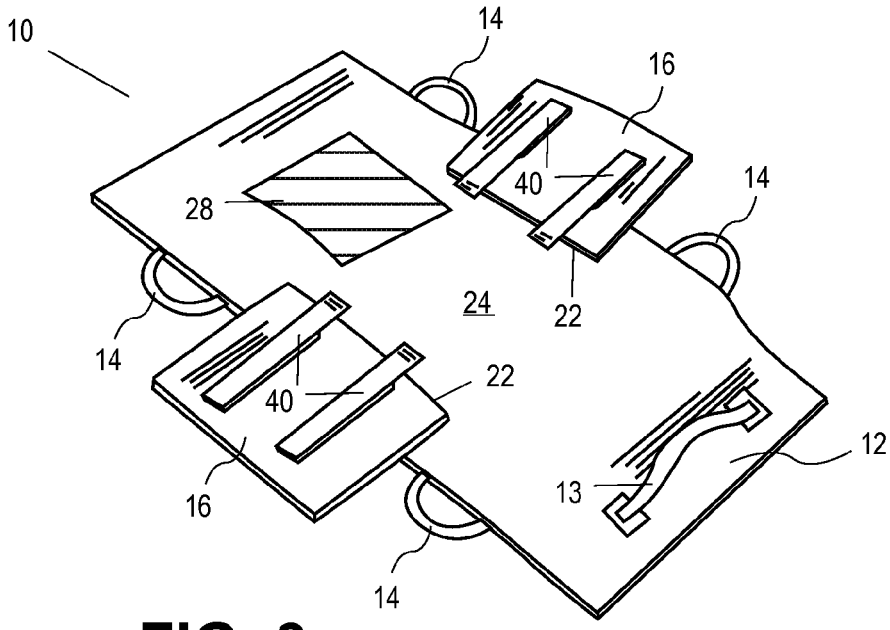
FIG. 3 depicts an assembled view of the device also showing straps and foot securement restraints and an optional non-slip pad.

Referring to FIG. 3, padded substrates 16 are shown attached at inner edge 17 to the center section 12. The back surface of padded substrates 16 have strips of hook and loop fasteners for securing. Straps 40 are also attached to the center section 12 at outer edge of center section 22 at one end. The bottom side of straps 40 have hook and loop fasteners for securing to padded substrates 16 when padded substrates 16 are wrapped around a patient's arm.

Optionally, device 10 may employ a permanent or removably engageable non-slip pad 28. The non-slip pad 28 will provide a means to prevent sliding when the patient is positioned on an angle. Also, in a one embodiment, foot securement restraint 13 is provided. The foot securement restraint 13 is coupled to top surface 24 and is wrapped around the legs of the patient and may be held by hook and loop fasteners. This foot securement restraint 13 enables the lower leg to remain positioned and secured during lifting or sliding of device 10.

Figure 4:
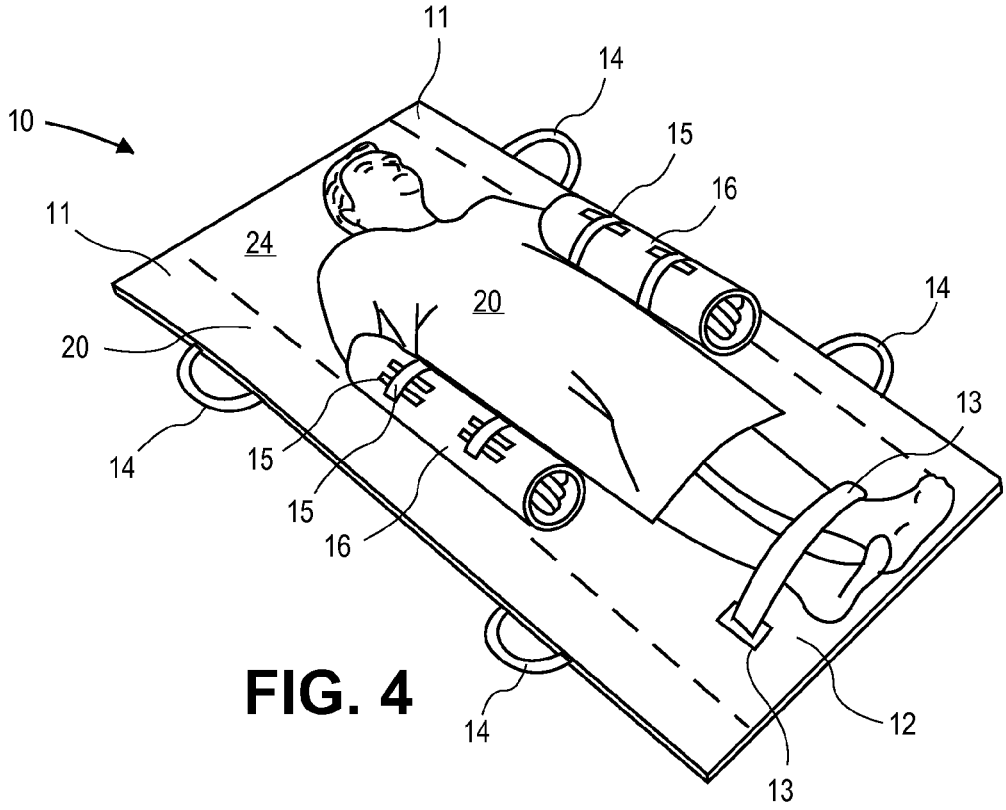
FIG. 4 illustrates an example the device in the as-used position with the patient's arms wrapped in the padded flexible substrates and lower legs secured.

In use, padded substrates 16 are employed to encircle and support a patient's arm when a patient lays on the center section 12 surface. This arm wrapping by the padded substrates 16 provide protection against the patient's arm moving outside the table area during fatigue and a potential pressure injury from contact with the underlying table or with a leaning surgeon while on an operating table. FIG. 4 illustrates the device 10 with the patient 20 positioned with both arms encircled within padded substrates 16. Patient 20 is positioned on the patient positioning device 10 and straps 40 are employable to hold the flexible, padded substrates 16 in wrapped configuration around the patient's arms and maintain the arms close to their body and out of the way of the surgeon. The patient's arms may be held in this position by the straps 40 or using the overlap mode of the device (described hereafter, FIGS. 5 and 12). While arm is in said wrapped engagement, minimal movement of said arm is permitted. Foot securement restraint 13 is also engaged. The present invention positions and secures patient 20 during transfer preventing injury to the patient and hospital staff when dragging the device 10 by handles 14. Furthermore, the patient is now more easily transferable between one support surface to another, for example, a gurney to an operating table. The handles 14, engaged around the perimeter of the overhang sections 11, provide personnel a secure grip while sliding or lifting a patient from one surface to another.

Figure 5:
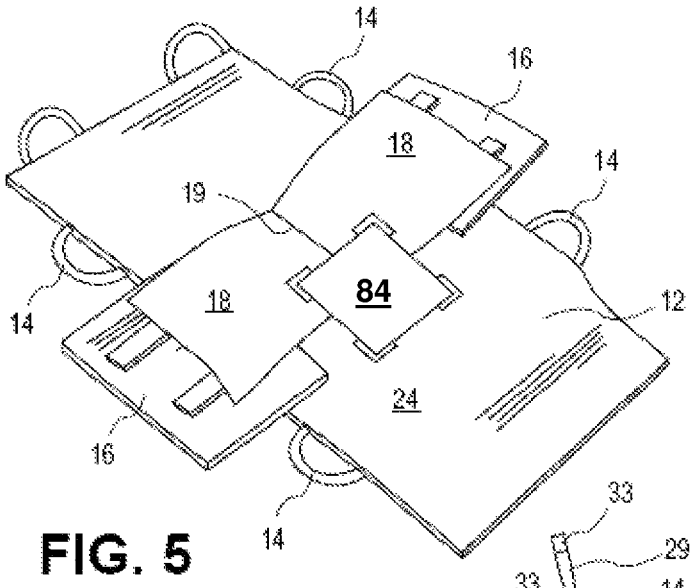
FIG. 5 shows the device with a foam pad removably engaged.
Figure 12:
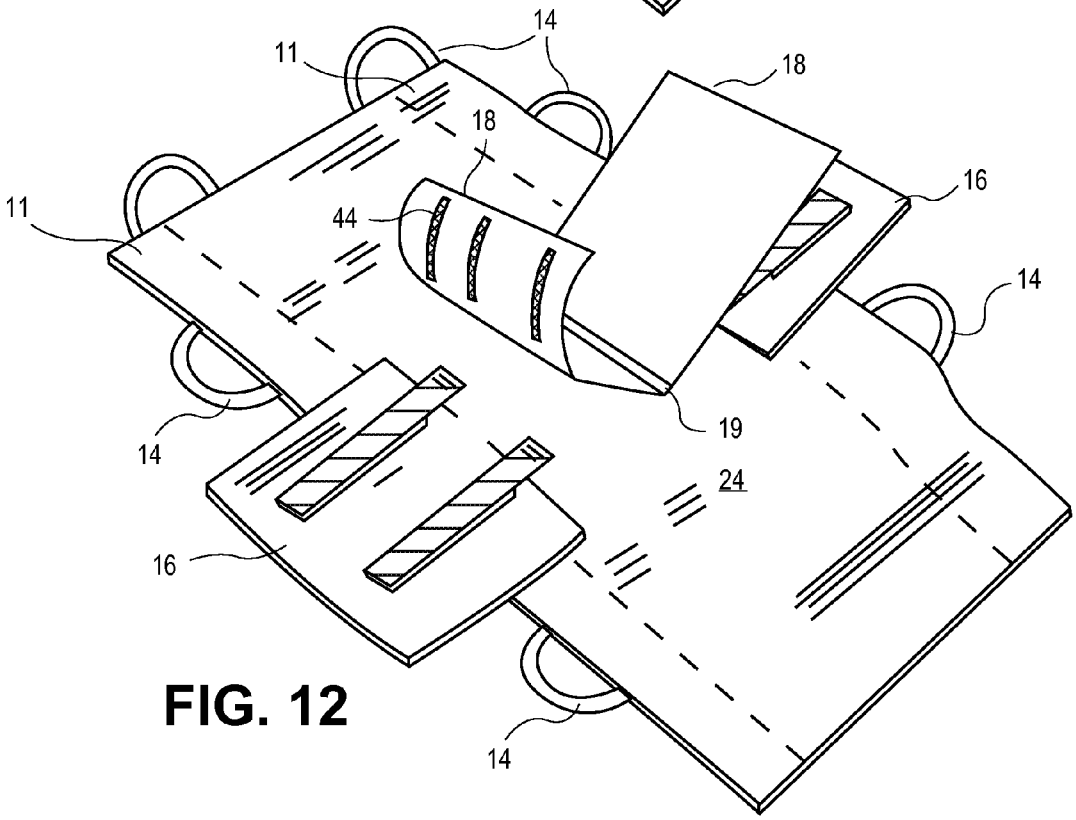
FIG. 12 shows the device with the padded substrates, overlap substrates, and formed inflated members.

In an example embodiment of the invention, an overlap system may be employed to further secure and elevate the patient's arms. The overlap system employs flexible, rectangular overlap substrates 18 oriented lengthwise across the width of the center section 12 and attached at the centerline 19 as depicted in FIGS. 5 and 12. The bottom surface of the overlap substrates 18 have strips of hook and loop fasteners 44 which fasten to the hook and loop fasteners on the padded substrates 16 when engaged. The overlap substrates 18 provide a secondary means to secure the patient's arms and as noted and shown in FIGS. 9 and 10, the overlap substrates 18 are tucked under a pad or mattress.

FIG. 5 shows the device 10 as optionally having a soft, foam pad 84 removably engaged to the top surface 24. This foam pad 84 is strategically placed in the buttock area to prevent pressure ulcers that may occur when a patient remains in the same position for an extended period of time such as during a long surgery or when a patient is confined to a hospital bed. Engagement may be by peel and stick adhesive or hook and loop fabric, or other means for removable engagement.

Figure 5A:
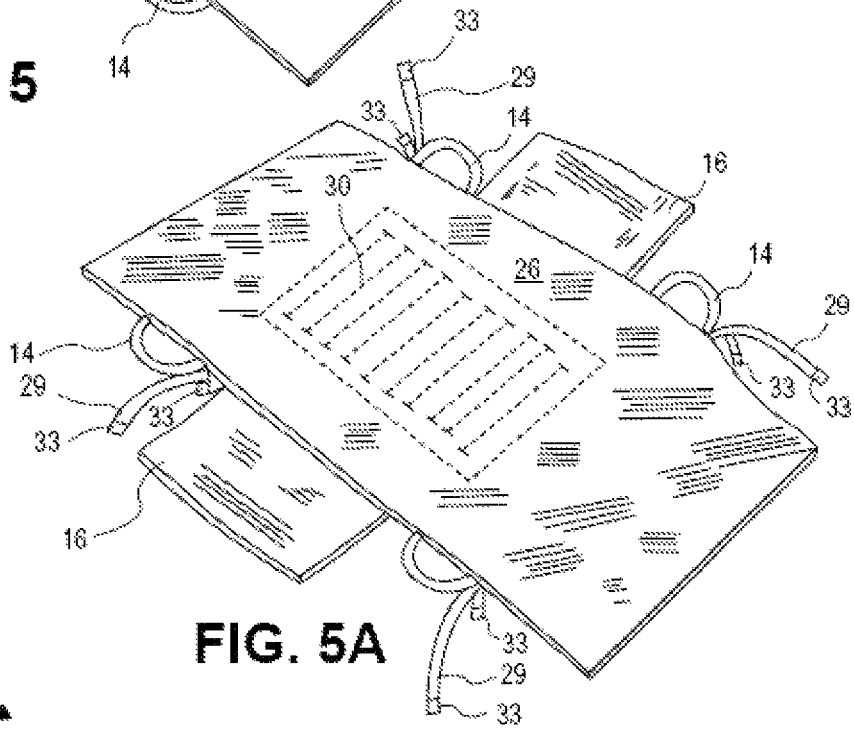
FIG. 5*a* details a bottom view of the device with an optional inflation support.

FIG. 5*a* shows a view of the bottom surface 26 of the device 10. Belt 29 has connector 33 attached at the respective ends and is coupled to handles 14. This belt 29 and connector 33 secure device 10 to the support surface, for example, an operating table or bed. The quantity and orientation of belt 29 and connector 33 is not limited by the drawing as shown but is merely simplified for illustrative purposes.

The bottom surface 26 is constructed of a slippery fabric such as vinyl or Teflon coated fabric or another fabric which has a low coefficient of friction. The slippery fabric provides a means to aid in sliding the patient 20 in transitions. Also, a dotted line outline is depicted illustrating the position of an optional inflation support 30. This inflation support 30 is sandwiched between the top surface 24 and bottom surface 26 surfaces and when inflated, allows for an easier sliding of the patient 20.

Figure 6:
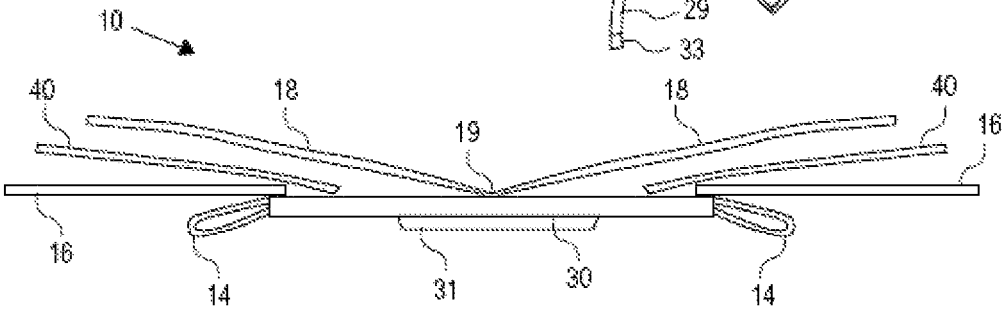
FIG. 6 illustrates a cut through view of the device ready for a patient and to be placed in an as-used position.
Figure 7:
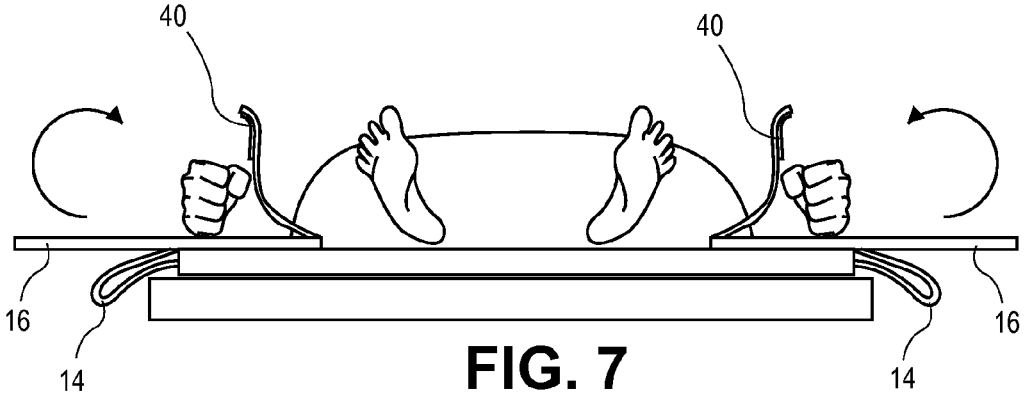
FIG. 7 depicts an end view of the as-used position of the device, prior to engagement of the padded substrates.

FIG. 6 shows a cut through view of the device 10 ready for a patient 20 and to be placed in an as-used position as noted in the following figures, FIGS. 7-10. FIG. 7 depicts an end view of the as-used position of an example of the device 10 prior to engagement of the padded arm restraints provided by the padded substrates 16. In use, the padded substrates 16 encircle the arm of the patient 20, and are then secured by straps 40 having hook and loop fasteners or other means of engagement.

Figure 8:
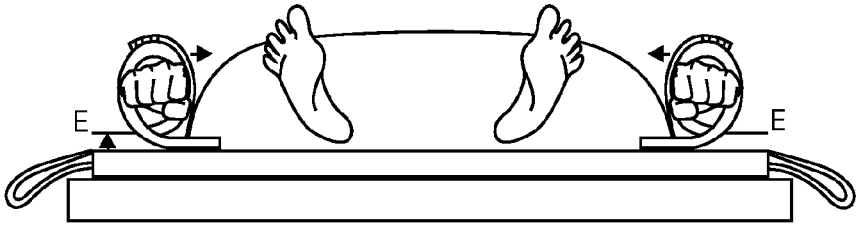
FIG. 8 shows the device in an as-used mode, with the padded substrates engaged, securing the patient's arms, while elevating the arms a distance "E" above the support surface.

Referring to FIG. 8, the padded substrates 16 encircle the patient's arms and are secured by straps 40 which comfortably hold the patient's arms close to the body. Additionally, the arms are padded and protected from injury from laying on the support surface too long or from the pressure of the surgeon's weight. Also, with the padded substrates 16 so engaged, it provides a means to elevate the arms a distance "E" above the support surface. This helps prevent nerve damage and tissue damage caused by an arm sitting on a surface too long during surgery.

Figure 9:
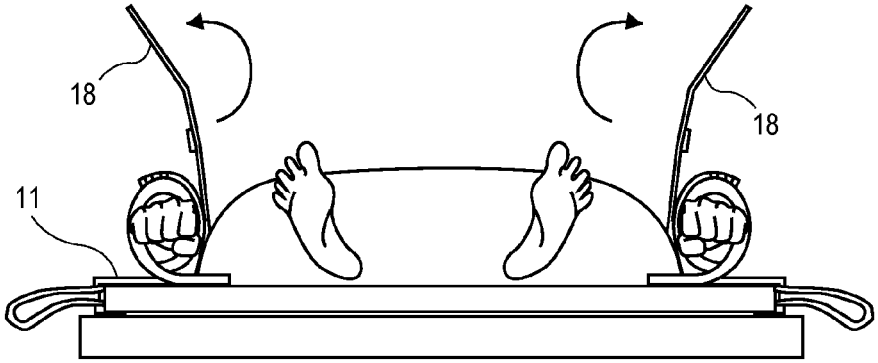
FIG. 9 shows the engagement of the overlap substrates which are wrapped over the patient's arms.
Figure 10:
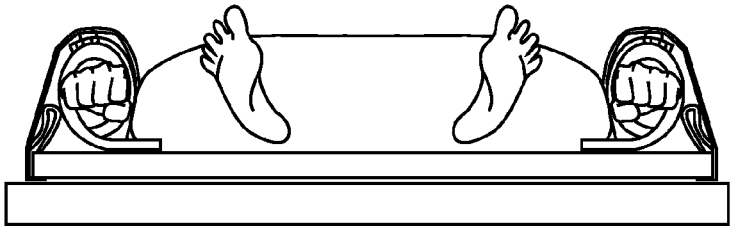
FIG. 10 illustrates the device with the overlap substrates wrapped over the patient's arms and are tucked under the mattress pad.

FIGS. 9-10 shows the engagement of overlap substrates 18 which may be wrapped over the patient's arms and tucked under the pad or mattress of the gurney or operating table. This provides secure positioning of the patient for surgery or transport.

Figure 11:
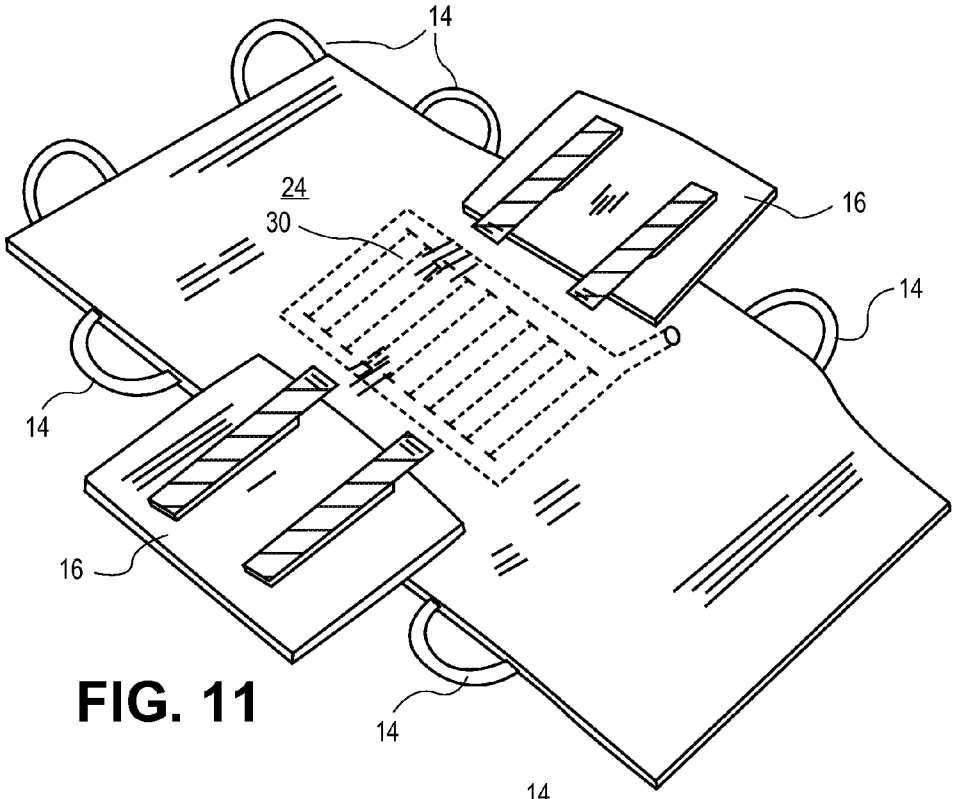
FIG. 11 depicts a top surface view of the device with optional inflatable support.
Figure 13:
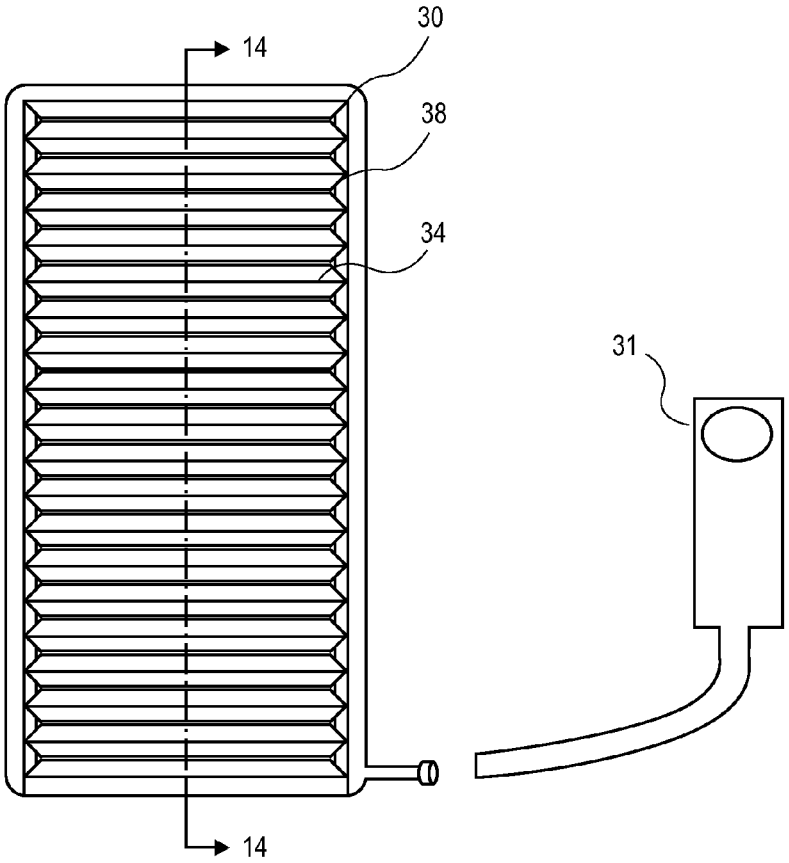
FIG. 13 shows the inflatable support with inflated tube members and section line 14.
Figure 14:
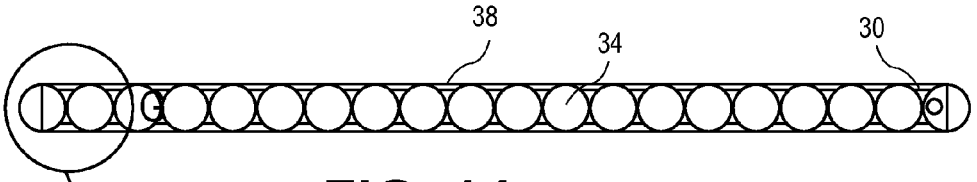
FIG. 14 is sectional view 14-14 of the inflatable support device of FIG. 13.
Figure 14A:
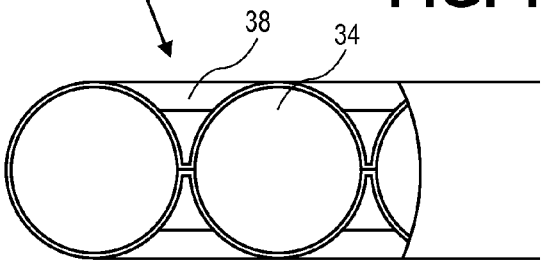
FIG. 14*a* depicts an enlarged view of a portion of FIG. 14 showing the inflatable support with member inflated.

FIG. 11 depicts a top surface view of the device with optional inflatable support, and FIG. 12 shows the device with the padded substrates, overlap substrates, and formed inflated members. FIGS. 13, 14 and 14*a* detail the inflatable support 30. FIG. 13 shows section line 14, FIG. 14 details section 14-14 and FIG. 14*a* depicts an enlarged view of FIG. 14. Referring to these figures, an air supply 31 provides compressed air to inflate the inflatable support 30 which is composed of a plurality of flexible ribs formed by inflated channels 34 between sealed spaces 38. The inflated support 30 provides a resilient support against the back of patient 20 while laying on the top surface of the device 10.

Figure 15:
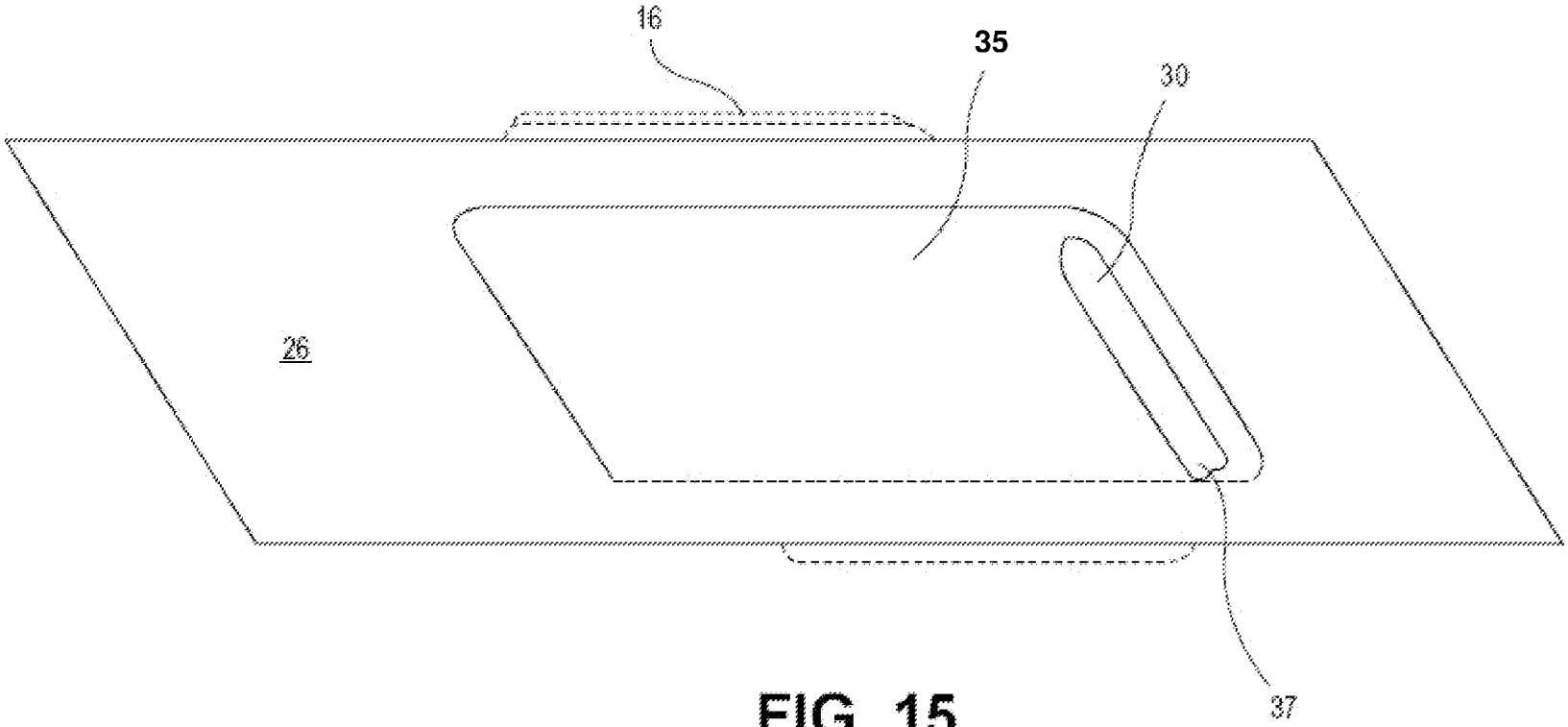
FIG. 15 is a bottom view of the device showing a cavity configured for insertion of the inflatable support member therein.

FIG. 15 shows a bottom perspective view of the device 10 having the bottom surface 26 and a cavity 35 sized to surround the inflatable support 30 which may be inserted within the cavity 35 through an elongated aperture 37. The placement of the cavity 35 allows the device 10 to be used with or without the inflatable support 30. The exterior of the cavity 35 would have the same slippery surface material thereon as the surrounding bottom surface 26.

In one embodiment, the inflatable support 30 is fully inflated just before moving patient 20 from one support surface to another. The fully inflated inflatable support 30 along with the slippery material of the exterior of the cavity 35 and bottom surface 26 greatly aids when sliding or translating the device 10 with the patient thereon due to significant reduction in friction. This means to ease sliding is provided by the placement of the axis of the parallel inflatable channels 34 running traverse to the position of the patient 20, on the top of the device 10. So positioned, members formed by the inflated channels 34 run the same direction as the sliding of the patient 20 from one surface to another and make such sliding easier. During surgery and after a lateral transfer, the inflatable support 30 should be fully deflated.

In another embodiment, the inflatable support 30 can also be partially inflated. In this mode, the partially inflated inflatable support 30 helps redistribute the weight of the patient thus reducing the surface pressure on the patient's body during surgery. While fundamental characteristics and features of devices have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the disclosure. It should also be understood that various substitutions, modifications, and variations may be made by those skilled in the art without departing from the spirit or scope of the disclosure. Consequently, all such modifications and variations and substitutions are included within the scope of the disclosure including the following claims.

What is claimed is:

1. A patient positioning device, comprising:

a planar sheet having first and second side edges and first and second end edges having a top surface;

said sheet configured for positioning of a patient thereon, the patient being supported by said top surface with said first and second side edges adjacent to arms of said patient;

a first flexible substrate and a second flexible substrate each coupled to said sheet, wherein said first and second substrates wrap around an adjacent arm of said patient creating a wrapped engagement;

a first overlap substrate and a second overlap substrate each oriented across said sheet and attached to said sheet only at a centerline thereof;

wherein said wrapped engagement protects said arms from injury caused by pressure imparted thereon during surgery or transport;

wherein said first and second overlap substrates wrap over and engage a respective said wrapped engagement and are configured to tuck under an underlying support surface to hold said arms in an elevated position above said planar sheet and said underlying support surface wherein said elevated position prevents injury to said arm from said planar sheet and said underlying support surface; and wherein said patient laying on said planar sheet may be lifted by or slid with said planar sheet.

2. The patient positioning device of claim 1, further comprising:

one or more straps each having a first end coupled to said planar sheet;

wherein said one or more said straps is configured to engage and fasten to a respective said flexible substrate when said substrate is in said wrapped engagement to hold a respective arm of said patient securely against a respective side of said patient and in said elevated position.

3. The patient positioning device of claim 1, further comprising:

a foot securement strap positioned on said top surface of said planar sheet to removably engage around a lower leg of said patient;

wherein said securement strap maintains said lower leg of said patient adjacently positioned on said top surface during said lifting or sliding of said planar sheet.

4. The patient positioning device of claim 1, wherein a bottom surface of said planar sheet has a low coefficient of friction material to aid in sliding said planar sheet.

5. The patient positioning device of claim 4, wherein said material comprises PTFE impregnated fabric, PTFE coated fabric, spunbond fabric, fabric which when formed is flexible and has a slippery surface, rip-stop fabric, micro fiber-based materials woven nylon, micro fiber-based materials woven from polyester, or combinations thereof.

6. The patient positioning device of claim 1, further comprising:

an inflatable support adjacent to said sheet;

wherein said inflatable support, when in an inflated condition, provides a resilient support against a back of said patient; and wherein said inflatable support, when in a partially inflated condition, redistributes a weight of said patient.

7. The patient positioning device of claim 6, wherein said inflatable support is rectangular shaped and sized to be approximately 20 inches by 40 inches.

8. The patient positioning device of claim 6, further comprising a cavity positioned at a bottom surface of said planar sheet, said cavity configured to receive said inflatable support.

9. The patient positioning device of claim 6, wherein said inflatable support comprises a plurality of inflatable channels.

10. The patient positioning device of claim 1, further comprising:

two or more grip handles positioned at least along said first and second side edges;

wherein said grip handles may be used to lift or slide said planar sheet.

11. The patient positioning device of claim 9, wherein said inflatable channels are disposed transverse to said patient in order to lower the resistance to sliding of said sheet.

12. The patient position device of claim 1, wherein the first and second flexible substrates are substantially planar.

13. The patient positioning device of claim 1, further comprising:

one or more equipment straps coupled to said planar sheet;

said equipment straps capable of facilitating attachment to said patient of at least one of a medical device, an intravenous tube, a catheter tube, a piece of medical equipment, or combinations thereof.

14. The patient positioning device of claim 1, further comprising:

a pocket having one open end, said pocket being coupled to said top surface of said planar sheet, and said pocket capable of storing at least one of a medical device, a suction tip, a suction tubing and a piece of medical equipment;

wherein said medical device, suction tip, suction tubing or medical equipment is attached to said patient.

15. The patient positioning device of claim 1, wherein, while said arms are in said wrapped engagement, minimal movement of said arms is permitted.

16. The patient positioning device of claim 1, further comprising a pad coupled to said top surface; wherein said pad is positioned under a buttock area of said patient.

17. The patient positioning device of claim 1 wherein said positioning device is capable of being lifted to transport said patient thereon.

18. A method for positioning a patient, comprising the steps of:

laying a positioning device on an underlying support surface, said positioning device including a planar sheet with a top surface, a first flexible substrate coupled to said planar sheet, a first strap coupled to said sheet, and a first overlap substrate oriented across said sheet and attached to said sheet only at a centerline thereof;

placing said patient on said top surface of said positioning device;

wrapping said first flexible substrate substantially around a first arm of said patient;

engaging said first strap around said first flexible substrate to hold said first arm of said patient against a respective side of said patient in a secured position;

wrapping said first overlap substrate over said first flexible substrate and tucking said first overlap substrate under said underlying support surface; and wherein said first arm of said patient is in an elevated position above said planar sheet and said underlying support surface, wherein said elevated position prevents injury to said first arm from said planar sheet and said underlying support surface.

19. The method for positioning a patient of claim 18, further comprising the steps of:

wrapping a second flexible substrate substantially around a second arm of said patient, said second flexible substrate being coupled to said sheet;

engaging a second strap around said second flexible substrate to hold said second arm of said patient against a respective side of said patient in a second secured position;

wrapping a second overlap substrate over said second flexible substrate and tucking said second overlap substrate under said underlying support surface, said second overlap substrate oriented across said sheet and attached to said sheet only at a centerline thereof; and wherein said second arm of said patient is in said elevated position above said planar sheet and said underlying support surface, wherein said elevated position prevents injury to said second arm from said planar sheet and said underlying support surface.

* * * * *